US006012542A

United States Patent [19]

Accordino

[11] Patent Number: 6,012,542

[45] Date of Patent: Jan. 11, 2000

[54] BASS AMPLIFYING SYSTEM FOR RADIOS

[76] Inventor: John A. Accordino, 204 Carson Ave., Gibbstown, N.J. 08027

[21] Appl. No.: 09/333,458

[22] Filed: Jun. 15, 1999

[51] Int. Cl.[7] ..... A47B 81/06

[52] U.S. Cl. ..... 181/199; 181/152; 181/156

[58] Field of Search ..... 181/141, 152, 181/156, 153, 199

[56] References Cited

U.S. PATENT DOCUMENTS

| | | | |
|---|---|---|---|
| 2,642,948 | 6/1953 | Olson | 181/152 |
| 5,296,656 | 3/1994 | Jung | 181/152 |
| 5,468,922 | 11/1995 | Hanba | 181/199 |
| 5,523,524 | 6/1996 | Prokisch et al. | 181/156 |
| 5,696,357 | 12/1997 | Starobin | 181/156 |
| 5,731,553 | 3/1998 | Ledoux | 181/156 |
| 5,844,176 | 12/1998 | Clark | 181/148 |

*Primary Examiner*—Khanh Dang
*Attorney, Agent, or Firm*—Henderson & Sturm

[57] ABSTRACT

A bass amplifying system (10) for radios (100) having mounted speakers; wherein, the system (10) comprises a combined enclosure and support unit (11) including a cover member (30) pivotally associated with a base member (20) having an elevated support platform (26) dimensioned to receive a radio (100); wherein, the cover member (30) and the base member (20) are provided with acoustical insulating means (36), (26), (37) for capturing sound waves within the interior of the enclosure and support unit (11) and redirecting the sound waves through an acoustical horn (28) formed in the base member (20).

9 Claims, 1 Drawing Sheet

BASS AMPLIFYING SYSTEM FOR RADIOS

BACKGROUND OF THE INVENTION

1. Field of the Invention

The present invention relates to the field of acoustical amplifying arrangements in general and in particular to an adjustable bass amplifying support system for radios.

2. Description of Related Art

As can be seen by reference to the following U.S. Pat. Nos. 5,296,656; 5,523,524; 5,696,357; 5,844,176; and 5,731,553, the prior art is replete with myriad and diverse bass amplifying arrangements that are designed to enhance acoustic sound waves.

While all of the aforementioned prior art constructions are more than adequate for the basic purpose and function for which they have been specifically designed, they are uniformly deficient with respect to their failure to provide a simple, efficient, and practical bass amplifying system that both elevates and enhances the aesthetic appearance of a boom box style radio while also serving as a bass amplifier for the radio.

As most music lovers are aware, a significant portion of the acoustical wave energy that is produced by "boom-box" style radios is dissipated and dispersed away from the listener due to the placement and orientation of the various speakers in the radio.

As a consequence of the foregoing situation, there has existed a longstanding need for a new and improved type of acoustical amplifier which will redirect and amplify the bass sounds which emanate from the rear of a conventional "boom box" style portable radio; and, the provision of such a construction is a stated objective of the present invention.

BRIEF SUMMARY OF THE INVENTION

Briefly stated, the bass amplifying system for radios that forms the basis of the present invention comprises in general a combined enclosure and support unit that includes a lower base support member and an upper contoured lid member which is pivotally connected to the base member so that different sized radios can be captively engaged between the lower support member and the upper lid member.

As will be explained in greater detail further on in the specification, the front portion of the base member defines a raised support platform which is dimensioned to receive and support the bottom of a radio wherein the face of the support platform is provided with at least one sound outlet for directing captured sound waves from the enclosure and support unit.

Furthermore, the rear portion of the base member is pivotally connected to the rear portion of the contoured lid member such that the face panel of the lid member which is provided with a resilient sealing gasket can captively engage the top and sides of different sized portable radios in a sound proof fashion.

As a consequence, the sound waves that are generated by the speakers and which emanate from the rear of the radio will be captured and redirected within the enclosure and support unit so that the sound waves can ultimately pass through the sound outlet in the face of the support panel.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
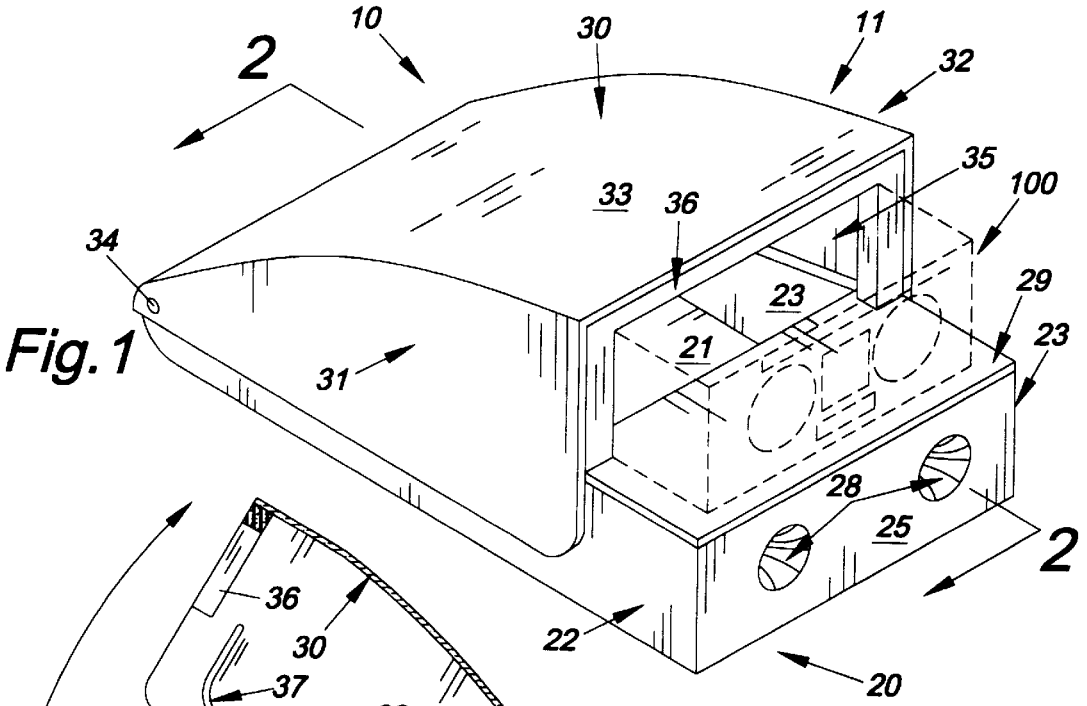
FIG. 1 is a perspective view of the bass amplifying system for radios that forms the basis of the present invention.

As can be seen by reference to the drawings, and in particular to FIG. 1, the bass amplifying system for radios that forms the basis of the present invention is designated generally by the reference number 10. The amplifying system 10 comprises in general a combined enclosure and support unit 11 and this unit will now be described in detail.

Figure 2:
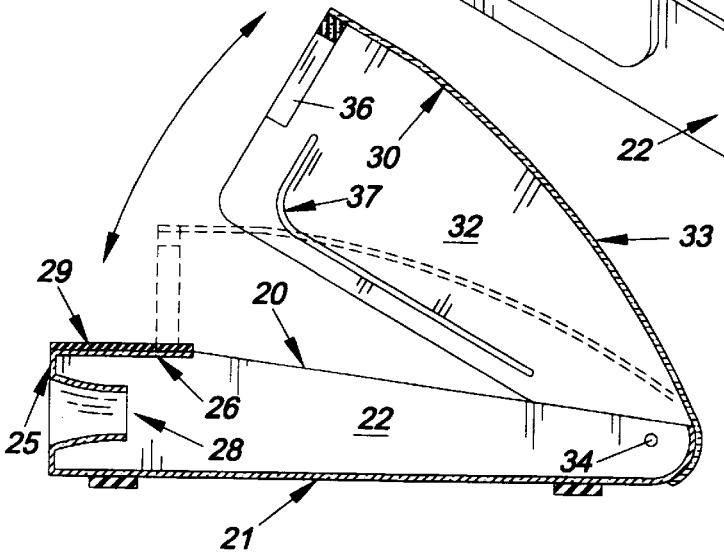
FIG. 2 is a cross-sectional view taken through line 2—2 of FIG. 1, and showing the combined support and enclosure unit in the open position; and, FIG. 3 is an enlarged cross-sectional view showing the combined support and enclosure unit in the closed position.
Figure 3:
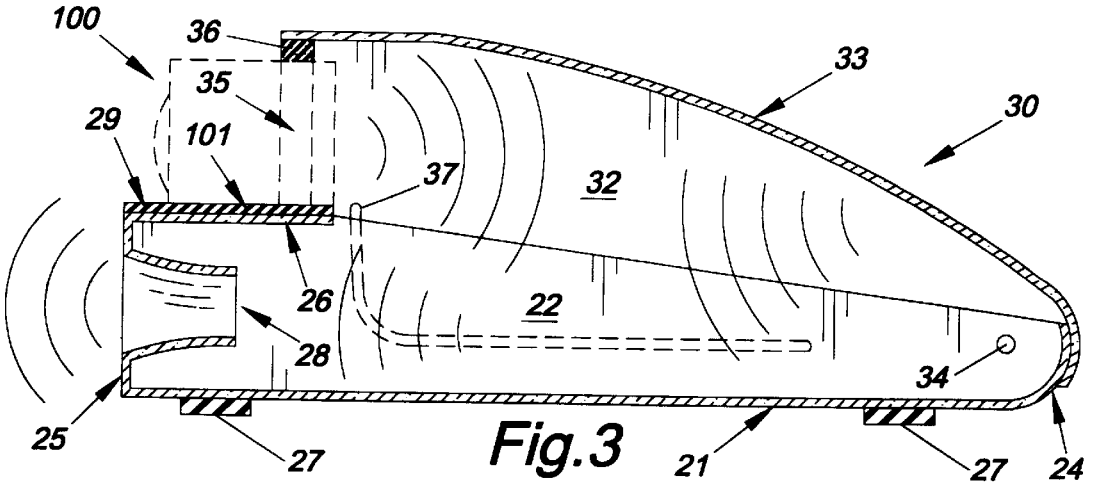

As shown in FIGS. 1 through 3, the combined support and enclosure unit 11 comprises in part an elongated base member 20 having a generally flat bottom 21, a pair of rearwardly tapered raised sidewalls 22, 23, a curved rear wall 24, a vertical face panel 25, and an elongated generally rectangular top panel 26, which is dimensioned to receive and support the bottom surface 101 of a radio 100.

In addition, the bottom 21 of the base member 20 is provided with a plurality of resilient foot pads 27, the face panel 25 is provided with a pair of recessed acoustical horns 28 and the top panel 26 is provided with a resilient covering 29 whose purpose and functions which will be explained in greater detail further on in the specification.

As can also be seen by reference to FIGS. 2 through 3, the combined support and enclosure unit 11 also comprises a contoured cover member 30 having a pair of opposed sides 31, 32, a curved top surface 33, wherein the rear portion of the cover member 30 is pivotally secured as at 34 to the rear portion of the base member 20.

In addition, the front portion of the cover member 30 is provided with an open mouth 35 which is at least partially surrounded by a generally inverted U-shaped resilient sealing gasket 36 which extends across the front of the top 33 and of the cover member 30 at least partially down the leading edges of the opposed sides 31, 32 of the cover member 30; wherein, the sealing gasket 36 and the resilient cover 29 on the support panel 26 combine to acoustically sealingly engage the periphery of a portable radio 100.

As can best be seen by reference to FIG. 2, the opposed sides 31, 32 of the cover member 30 are each provided with a generally L-shaped resilient acoustic sealing strip 37 which is adapted to engage the exterior surface of the raised sidewalls 22, 23 of the base member 20 when the cover member 30 is in the closed position to acoustically insulate the interior of the combined enclosure and support unit 11.

Turning now to FIGS. 1 and 3, it can be appreciated that in order to utilize the bass amplifying system 10, all that is required is to pivot the cover member 30 upwardly relative to the base member 20 so that the periphery of a radio 100 can be resiliently engaged by the resilient covering 29 on the horizontal support panel 26 and the resilient gasket 36 on the front portion of the cover member 30.

Then, when the radio 100 is turned on, the sound from the rear of the radio 100 will be projected against the curved interior surfaces of the cover member 30 and base member 20 such that the sound waves will be redirected to the acoustical horns 28 on the face panel 25 of the base member 20.

In this manner, the portable radio 100 will be supported on an elevated platform 26 on the bass amplifying system 10 and the bass sound waves will be redirected within the combined enclosure and support unit 11 to pass through the acoustical horns 28 in a well recognized fashion.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A bass amplifying system for a radio having at least one speaker wherein the system comprises:

a combined enclosure and support unit including: an elongated base member having a bottom, a curved rear end, a front end provided with a vertical face panel having at least one acoustical horn and an elongated top panel extending rearwardly from the face panel and dimensional to receive the bottom of a radio; and, a contoured cover member having a generally curved rear portion pivotally associated with the curved rear end of the cover member, wherein the cover member has a front end provided with an open mouth which is dimensioned to receive the top and sides of the radio.

2. The system as in claim 1; wherein, the top panel of the base member is provided with a resilient covering adapted to resiliently engage the bottom of the radio.

3. The system as in claim 2; wherein, the open mouth of the cover member is provided with a resilient gasket that is dimensioned to engage the periphery of the radio.

4. The system as in claim 3; wherein, the base member is further provided with a pair of opposed raised sidewalls.

5. The system as in claim 4; wherein, the cover member is provided with a curved top and a pair of opposed sides.

6. The system as in claim 5; wherein, each of the opposed sides of the cover member are provided with a resilient acoustic sealing strip that is adapted to engage one of the raised sidewalls of the base member.

7. The system as in claim 6; wherein, the bottom of the base member is provided with a plurality of resilient foot pads.

8. A bass amplifying system for a radio having at least one speake wherein the system comprises:

a combined enclosure and support unit including a base member having a curved rear portion and a front portion provided with an acoustical horn and a raised support platform dimensioned to receive a radio;

a contoured cover member having an open mouth dimensioned to partially surround a radio; and, means for acoustically insulating the rear portion of a radio within the enclosure defined by the base member and the cover member.

9. The system as in claim 8; wherein, the cover member has a rear portion which is pivotally associated with the rear portion of the base member.

* * * * *